US005463457A

United States Patent [19]

Takeuchi et al.

[11] Patent Number: 5,463,457

[45] Date of Patent: Oct. 31, 1995

[54] IMAGE FORMING APPARATUS CAPABLE OF CHANGING IMAGE FORMING CONDITIONS DEPENDING ON SIDE OF RECORDING MATERIAL

[75] Inventors: Tatsuo Takeuchi; Yasuo Nami, both of Kawasaki; Jiro Ishizuka, Machida, all of Japan

[73] Assignee: Canon Kabushiki Kaisha, Tokyo, Japan

[21] Appl. No.: 127,881

[22] Filed: Sep. 28, 1993

[30] Foreign Application Priority Data

Sep. 30, 1992 [JP] Japan ..... 4-285171

[51] Int. Cl.[6] ..... G03G 21/00

[52] U.S. Cl. ..... 355/313; 355/284; 355/319

[58] Field of Search ..... 355/284, 285, 355/308, 309, 313, 319; 271/9, 301

[56] References Cited

U.S. PATENT DOCUMENTS

| | | | |
|---|---|---|---|
| 4,585,336 | 4/1986 | Tanaka | 355/319 |
| 4,685,797 | 8/1987 | Ito | 355/313 |
| 4,811,053 | 3/1989 | Ito et al. | 355/313 X |
| 5,008,715 | 4/1991 | Imaizumi et al. | 355/313 |
| 5,126,762 | 6/1992 | Takeuchi et al. | 346/135.1 |
| 5,132,739 | 7/1992 | Mauer et al. | 355/319 X |
| 5,220,395 | 6/1993 | Yamashita et al. | 355/313 |

*Primary Examiner*—William J. Royer

*Attorney, Agent, or Firm*—Fitzpatrick, Cella, Harper & Scinto

[57] ABSTRACT

An image forming apparatus includes a manual sheet feeder for permitting a recording material to be manually fed; cassette feeder for feeding a recording material from a cassette; an image forming device for forming an image on the fed recording material; double side mode selector for selecting a double side mode in which the images are formed on both surfaces of the recording material; wherein the image forming device is conditioned for forming the images on both surfaces, when the manual feeder is in manual feeding state, and the double side mode is selected by the double side mode selecter.

7 Claims, 6 Drawing Sheets

IMAGE FORMING APPARATUS CAPABLE OF CHANGING IMAGE FORMING CONDITIONS DEPENDING ON SIDE OF RECORDING MATERIAL

FIELD OF INVENTION AND RELATED ART

The present invention relates to an image forming apparatus such as a copying machine or printer, and, in particular, an image forming machine capable of forming an image on both surfaces of a recording material.

In an image forming apparatus incorporating an electrophotographic system, electrostatic recording system, or the like, it is commonly a practice to use a fixing roller coated with a parting agent, such as silicone oil, for fixing the image.

Also, in a full-color image forming apparatus, the image is transferred with the use of a transfer drum on which the recording material is carried.

When the image is formed on both sides of the transfer material, using such an apparatus that incorporates the transfer drum, the parting agent adhering to the recording material migrates to the transfer drum, and then, to a photosensitive member, whereby an inferior image is produced.

This problem of an inferior image caused by deposition of the separating liquid becomes extremely evident when the image is mistakenly formed on a resin film which does not absorb the parting agent.

It is preferable to change the image forming condition depending on whether the image is going to be formed on the first side of the recording material or the second side. However, when an image forming apparatus is not equipped with a passage which automatically turns over the recording material, it is not possible to specify under what kind of condition the image forming setting should be changed.

SUMMARY OF THE INVENTION

The principle object of the present invention is to provide an image forming apparatus capable of changing the image forming setting between the first side of the recording material and the second side, without use of the passage which automatically turns over the recording material.

According to an aspect of the present invention, the parting agent is prevented from migrating to the image bearing member during an operation in which the image is formed on both sides of the recording material.

According to another aspect of the present invention, an image forming apparatus comprises: a manual sheet feeding means for allowing the recording material to be manually fed, an automatic feeding means for feeding the recording material from a cassette, an image forming means for forming an image on the fed recording material, and double side mode selecting means for selecting the double side image formation mode, wherein the image forming means is capable of selecting a proper double side image forming mode depending on whether or not the manual feeding means is in manual mode and whether or not the double side image forming mode is set.

According to a further aspect of the present invention, an image forming apparatus is capable of forming an image on both surfaces of the recording material, and comprises: a recording material feeding member for feeding a recording material into the apparatus, image bearing member for bearing an image, rotary transferring member which rotates while carrying, on the peripheral surface, the recording material fed from the recording material feeding member, conveying means for conveying the recording material from the recording material feeding member to the rotary transferring member, fixing means for fixing the image on the recording member, and discharging member for discharging the recording material An a manner to keep the surface, on which the image is fixed by the fixing means, facing upward.

According to yet another aspect of the present invention, an image forming apparatus comprises: an image bearing member, rotary transferring member for carrying a recording material while rotating, rotary fixing means for fixing the image on the recording material while conveying the recording material through a nip, coating means for coating a parting agent on the rotary fixing means mode selecting means for selecting a mode for forming the image on both surfaces of the recording material. discriminating means for discriminating the side of a recording material of resin film, and blocking means for blocking the recording material of resin film from reaching the rotary transferring member when the discriminating means detects the back surface of the recording material of resin film.

According to another aspect of the present invention, an image forming apparatus comprises: a discriminating means for discriminating the type of a recording material (whether or not the recording material is of the resin film), image forming means for forming an image on the recording material, and mode selecting means for selecting a double side recording mode wherein when the double side recording mode is selected by the mode selecting means, the image is formed on both surfaces of the recording material only when the discriminating means detect's that the recording material is not of the resin film.

These and other objects, features and advantage of the present invention will become more apparent upon consideration of the following description of the preferred embodiments of the present invention, taken in conjunction with the accompanying drawings.

DESCRIPTION OF THE PREFERRED EMBODIMENT

Hereinafter, a preferred embodiment of the present invention will be described, referring to drawings.

Figure 1:
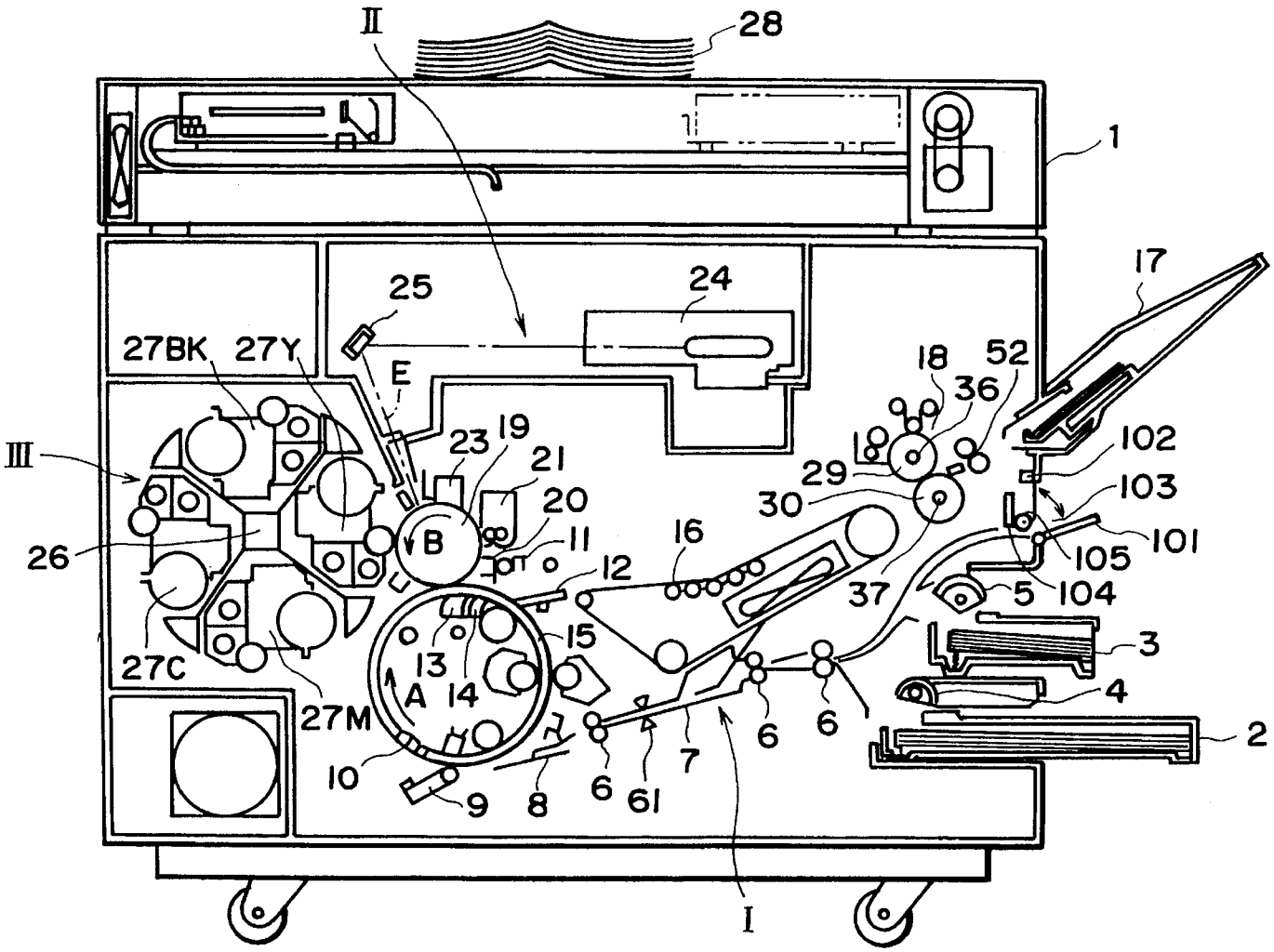
FIG. 1 is a schematic sectional view of a preferred embodiment of the electrophotographic color image forming apparatus in accordance with the present invention.

FIG. 1 is a sectional view of the preferred embodiment of the present invention.

Referring to FIG. 1, the electrophotographic color image forming apparatus in accordance with the present invention can be roughly divided into: a recording material feeding system I extending from the right side (right side in FIG. 1) of the main assembly 1 of the apparatus substantially toward the center of the main assembly 1 of the apparatus; a latent image forming station II disposed adjacent to the recording material feeding apparatus, substantially in the middle of the main assembly 1 of the apparatus; and a developing means disposed adjacent to the latent image forming station II, that is a rotary developing apparatus III in this embodiment.

First, the transfer material feeding system I will be described.

The right wall (wall on the right side in FIG. 1) of the main assembly 1 of the apparatus has an opening, through which recording material feeding trays 2 and 3 are loaded or removed. In the loaded state, a portion of each tray sticks out of the main assembly 1 of the apparatus. Approximately above these trays 2 and 3, feed rollers 4 and 5 are disposed. On the left side of these rollers 4 and 5, there is a rotary transfer drum 15, which is a transferring means rotatable in an arrow A direction. The distance between these feed rollers 4 and 5 and the rotary transfer drum 15 is bridged by conveying rollers 6 and guides 7 and 8. In the proximity of the outer circumferential surface of the transfer drum 15, there are an attraction roller 9, gripper 10, charger 11 for separating the recording material, and separating claw 12, being placed in this order as seen from the upstream side of the drum rotation. In the proximity of the inner circumferential surface of the transfer drum 15, a transfer charger 13 and a separation charger 14 for separating the recording material are disposed. On the portion of the transfer drum where the recording material is wrapped around, a transfer sheet (unshown) made of polyfluorovinylidene or the like is pasted, whereby the recording material is electrostatically attracted onto the transfer sheet.

Next to the upper right corner of the transfer drum 15, a conveyer belt 16 is provided adjacent to the separating claw, and at the downstream end (right end in FIG. 1) of conveyer belt means 16, a fixing apparatus 18 is located. At a further downstream location from the fixing apparatus 18, discharge tray 17 is located, which is removable from the main assembly 1, and extends outward from the main assembly when it is attached. Discharge rollers 52 discharge the recording material into discharge tray 17.

Next, the structure of the latent image forming station II will be described.

In FIG. 1, a photosensitive drum 19 is an image bearing member which is rotatable in an arrow B direction. The circumferential surface of the photosensitive drum 19 is placed in contact with the circumferential surface of the transfer drum 15. In the upper proximity of the photosensitive drum 19, there are a charge clearing charger 20, cleaning means 21, and primary charger 23, being situated in this order as seen from the rotational upstream side of the photosensitive drum. Also surrounding the photosensitive drum 19 are an image exposing means 24 such as a laser beam scanner for forming a latent electrostatic image on the circumferential surface of the photosensitive drum, and an imaging beam reflecting means 25 such as a mirror.

Lastly, the rotary developing apparatus III will be described.

At a location facing the circumferential surface of the photosensitive drum 19, a rotary frame 26 (hereinafter, rotary member) is disposed, in which four developing apparatus are mounted at equivalent positions in the circumferential direction. These four developers are yellow developing apparatus 27Y, magenta developing apparatus 27M, cyan developing apparatus 27C, and black developing apparatus 27BK, which visualize that is, develop, the latent electrostatic image formed on the circumferential surface of the photosensitive drum 19.

Next, the overall operational sequence of the above described image forming apparatus will be described. First, the image formation in a full-color mode will be briefly described.

As the photosensitive drum rotates in an arrow B direction, the photosensitive member of the photosensitive drum 19 is uniformly charged by the primary charger 23. In this embodiment, the operational speed of each component (hereinafter, "processing speed) is 160 mm/sec. After the photosensitive member is uniformly charged by the primary charger 23, the photosensitive member is exposed to a laser beam E modulated by the yellow image signal reflecting an original 28, whereby a latent electrostatic image is formed on the photosensitive drum 19. This latent electrostatic image is developed by the yellow developing apparatus 27Y which has been positioned at a predetermined developing location by the rotation of the rotary frame 26.

On the other hand, the transfer material conveyed through the conveying roller 6 and conveying guides 7 and 8 is gripped by the gripper 10 of the transfer drum 15. Then, it is subjected to the electrostatic force from the attraction roller 9 and its coordinating electrode, resulting thereby in being wrapped around the transfer drum 15. As the transfer drum 15 is rotated in synchronization with the photosensitive drum 19, in the arrow A direction, the visual image developed by the yellow developing apparatus 27Y is transferred by the transfer charger 13 onto the transfer material being carried on the transfer drum 15, at a location where the circumferential surface of the photosensitive drum 19 is in contact with the circumferential surface of the transfer drum 15. The transfer drum 15 continues to rotate to be prepared for the transfer operation for the next color, that is, the magenta, in this embodiment.

On the other hand, the photosensitive drum 19 is cleared of the charge by the charge clearing charger 20, and is cleaned by the cleaning means 21. Then, it is again charged by the primary charger to be exposed to the aforementioned imaging beam modulated, this time, by the magenta image signal. As for the rotary developing apparatus III, it is rotated while a latent electrostatic image is formed through the exposure by the imaging beam modulated by the magenta imaging signal, so that the magenta developing apparatus 27M is positioned at the aforementioned specific location for carrying out the predetermined magenta developing operation.

Continuingly, the above described image forming process is carried out for the cyan color and black. After four images of different color are transferred onto the transfer material on the transfer drum, these four visual images, being now on the transfer material, are cleared of the charge. Then, after being released from the grip of the gripper 10, the transfer material is separated from the transfer drum 15 by the separating claw 12 and is conveyed by the conveyer belt 16 to the fixing apparatus 18, where four images of different color are mixedly fixed, which concludes the full-color printing sequence, yielding a desired full-color print.

At this time, the speed at which the fixing operation is carried out by the fixing apparatus is 90 mm/sec, which is slower than the main processing speed, that is, 160 mm/sec.

This is because a sufficient amount of heat must be given to toner when two to four layers of toner which compose the unfixed image must be mixedly fused, which will be described later. In other words, the amount of heat given to the toner is increased by carrying out the fixing operation at a slower speed than that of the main operation.

As was described above, in order to create a color image, toners of different color form two to four layers; therefore, the toner used in an electrophotgraphic color image forming apparatus has a composition which will be described below.

The toner used to form color image formation is required to display good fusibility and mixability when subjected to heat. Therefore, toner having a sharp-melt characteristic, that is, having a low softening point and a low degree of melt viscosity, is used for this purpose. The use of such sharp-melt toner can widen the color reproduction range and can offer a color copy which is faithful to an original of full-color, or which has two or more colors.

The sharp-melt toner is produced by fusing, kneading, pulverizing and classifying a mixture of binder resin material such as polyester resin or styrene-acrylic ester resin material or the like, coloring agent (dye, sublimating dye) and electrification control agent. As desired, the toner powdery may contain various materials such as hydrophobic colloidal silica.

From the standpoint of the fixing characteristics and the sharp melting characteristics, the color toner preferably uses polyester resin material as a binder resin material. The sharp melting polyester resin includes for example a high polymer having ester linkage in the principal chain of molecules synthesized from diol compound and dicarboxylic acid.

In view of sharp melting characteristics, particularly preferred resins may be polyester resins obtained through polycondensation of at least a diol component selected from bisphenol derivatives represented by the formula:

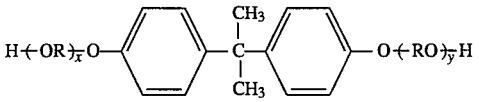

wherein R denotes an ethylene or propylene group; x and y are respectively a positive integer of 1 or more providing the sum (x+y) of 2 to 10 on an average and their substitution derivatives, and a two- or more-functioned carboxylic acid component or its anhydride or its lower alkyl ester, such as fumaric acid, maleic acid, maleic anhydride, phthalic acid, terephthalic acid, trimellitic acid, pyromellitic acid and mixtures thereof.

Figure 2:
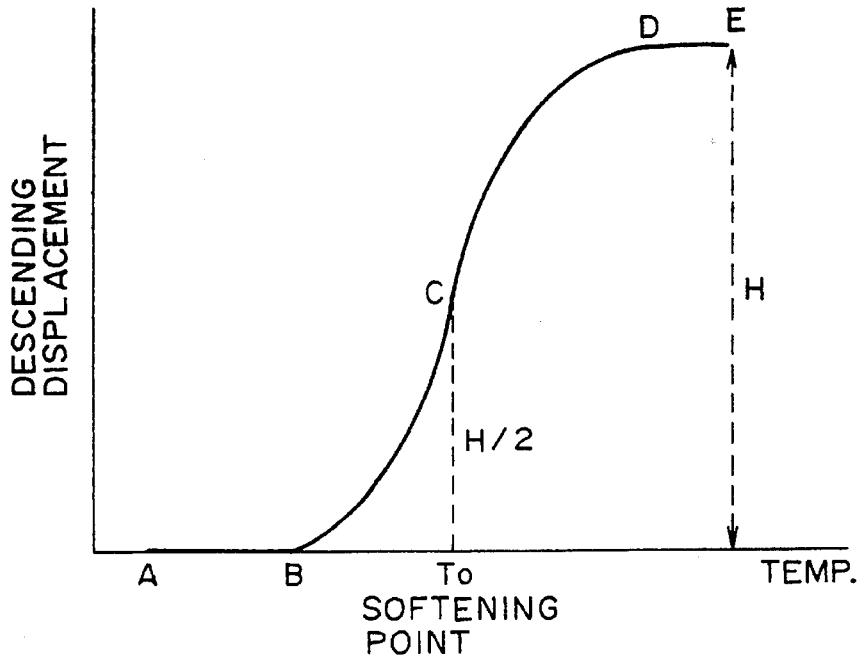
FIG. 2 is a graph to show the softening characteristic of the "sharp-meltable toner" usable with the present invention.

The softening point of the polyester resin is 75°–150° C., preferably 80°–120° C. FIG. 2 shows the softening characteristics of the toner containing the polyester resin as the binder resin. The measuring method of the softening point in this embodiment will be described.

A flow tester CFT-500A, available from Simazu Seisakusho, is used which has a die (nozzle) having a diameter of 0.2 mm and a thickness of 1.0 mm with the pressing load of 20 Kg. The initial temperature is set 70° C., and preliminary heating period is 300 sec. After the preliminary heating, the temperature is increased at the constant speed of 6° C./min. Then, the amounts of the plunger lowering are plotted relative to the temperature on the lowering amount vs. temperature curve (softening S curve). The weight of the toner is 1–3 g (precisely weighted) and the sectional area of the plunger is 1.0 $cm^2$. The softening S curve is as shown in FIG. 2. With the constant speed temperature increase, the toner is gradually heated, and it starts to flow (A-B). With further increase of the temperature, the fused toner flows out further (B-C-D) until the plunger lowering stops (D-E).

The height H of the S curve represent the total amount flown out, and the temperature T0 corresponding to the point C(H)/2 is the softening point of the material (toner).

Whether the toner and the binder resin have the sharp melt characteristics or not, can be determined on the measurement of the apparent fusing viscosity of the toner or the resin.

In this embodiment, the toner or the binder resin having the sharp melting characteristics means the toner satisfying the followings:

$$T1=90°–150° C.$$

$$|\Delta T|=|T1-T2|=5°–20° C.$$

where T1 is the temperature at which the apparent fusing viscosity is $10^3$ poise, and T2 is a temperature at which it shows $5\times10^2$ poise.

The sharp melting resin material having such a temperature-viscosity characteristics is characterized by the sharp viscosity decrease when being heated. The viscosity decrease brings about the proper mixing between the topmost toner layer and the bottommost toner layer, the abrupt increase of the transparency of the toner layers themselves, and therefore, the subtractive color mixture properly occurs.

The sharp melting color toner has strong affinity, and therefore, the toner off-set tends to occur. Therefore, in the fixing apparatus for the image forming apparatus using such a color toner, high parting property is desired to last long.

Hereinafter, referring to FIG. 3, the fixing apparatus 18 in accordance with the embodiment of the present invention will be described.

The fixing roller 29, that is, the fixing means, comprises: a metallic core 31 of aluminum, a HTV (high temperature vulcanized) silicone rubber layer 32 coated thereon, and a RTV (room temperature vulcanized) silicone rubber layer 33 coated thereon, and its measurements are 3 mm in thickness and 40 mm in diameter.

On the other hand, the pressure roller 30, that is, the pressing means, comprises: a metallic core 34 of aluminum 34, a 1 mm thick MTV silicone rubber layer 33 coated thereon, and a RTV silicone rubber layer 35 coated thereon, and its diameter is 40 mm.

The fixing roller 29 contains a halogen heater 36 which is a heating means, and the pressure roller 30 also contains a heater 37 in the metallic core 34 In the same manner as the fixing roller 29, whereby the heat is given from both sides of material to be heated. The temperature of the pressure roller 30 is detected by a thermistor 38 placed in contact with the pressure roller 30, and in response to the detected temperature, the halogen heaters 36 and 37 are controlled by a controller so that both temperatures of the fixing rollers 29 and the pressure roller 30 are kept at approximately 170° C. The fixing roller 29 and pressure roller 30 are caused to press each other with a total pressure of approximately 40 kg by an unshown pressing mechanism.

Figure 3:
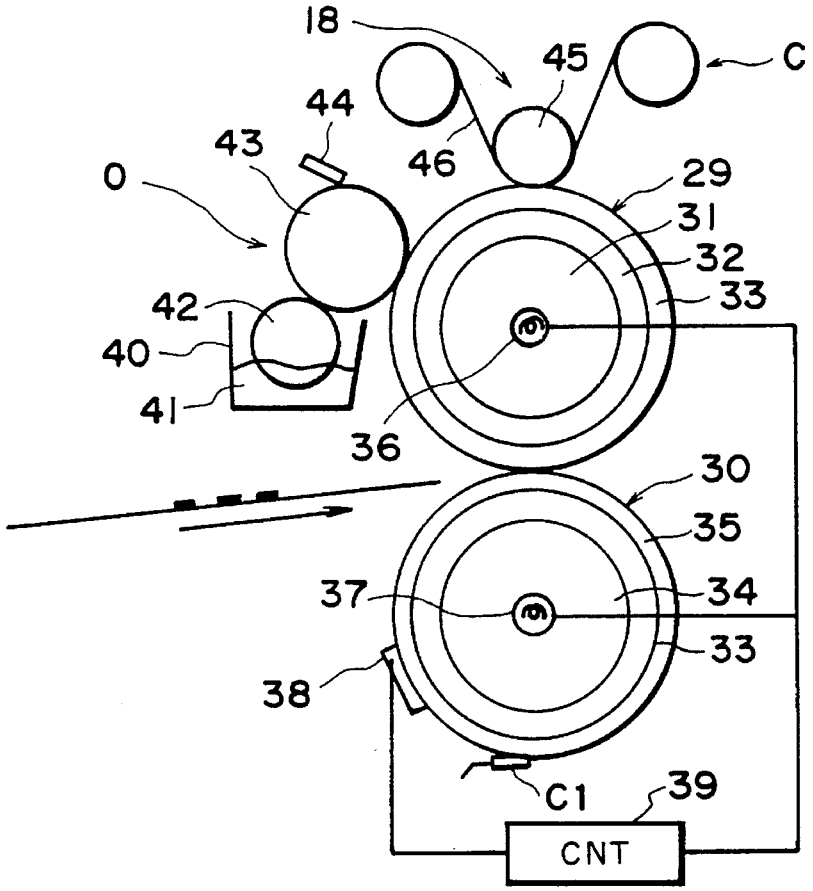
FIG. 3 is a schematic sectional view of a fixing apparatus usable with the present invention.

Referring to FIG. 3, a reference code O designates an oil coating apparatus which serves as a means for coating the parting agent; a reference code C, a cleaning apparatus; and a reference code C1 designates a cleaning blade fur removing the oil contamination of the pressure roller 30. In the oil coating apparatus O, dimethyl silicone oil 41 (KF96 300cs, available from Shinetsu Kagaku Kogyo Kabushiki Kaisha, Japan) in an oil pan 40 is picked up by an oil pick up roller 42, is transferred onto an oil coating roller 43, where its amount is regulated by a blade 44 for regulating the amount of the oil to be coated, and then, is coated on the fixing roller 29. In this embodiment, the amount of oil to be coated is regulated to be 0.08 g/A4, using a measuring method which will be described later.

The amount of the silicone oil to be coated by the oil coating apparatus O is determined in the following manner.

First, the weight of 50 sheets of A4 size white paper which are to be used as the recording materials is measured, and this weight is designated as $A_1$ (g), and the weight of the same 50 sheets is measured after they are passed between the fixing roller 29 and pressure roller 30, without transferring an image on these white sheets of paper, and without coating the silicone oil on the fixing roller 29, and this weight is designated as B(g). Next, the weight of another set of 50 sheets of the same A4 size white paper is measured, and this weight is designated as $A_2$(g), and then, they are measured after being passed between the fixing roller 29 and pressure roller 30, with the silicone oil being coated on the rubber layer, but without transferring the image on these white sheets, and this weight is designated as C(g).

Then, an amount X(g) of the coated silicone oil per sheet of A4 size white paper can be obtained by the following equation.

$$X=(C+A_1-B-A_2)/50$$

As for the cleaning apparatus C, a web 46 of Nomex (trade name), which is non-woven fabric, is pressed on the fixing roller 29 by a pressure roller 45, whereby the fixing roller 29 is cleaned. The web 46 is taken up as needed by an unshown take-up apparatus to prevent the toner from building up at the contact point.

Next, the double side image formation mode of the embodiment of the image forming apparatus in accordance with the present invention will be described.

Figure 4:
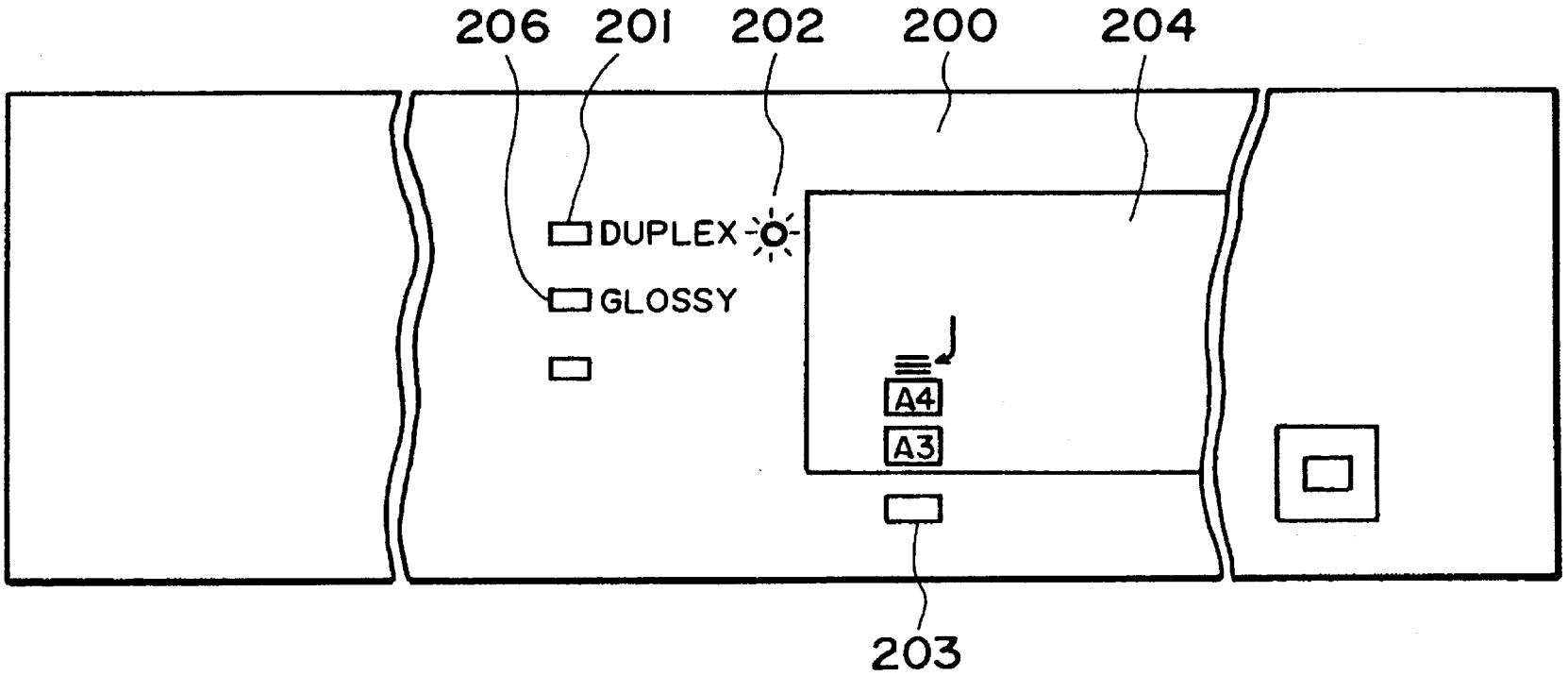
FIG. 4 depicts an embodiment of a control panel usable with the present invention.
Figure 6:
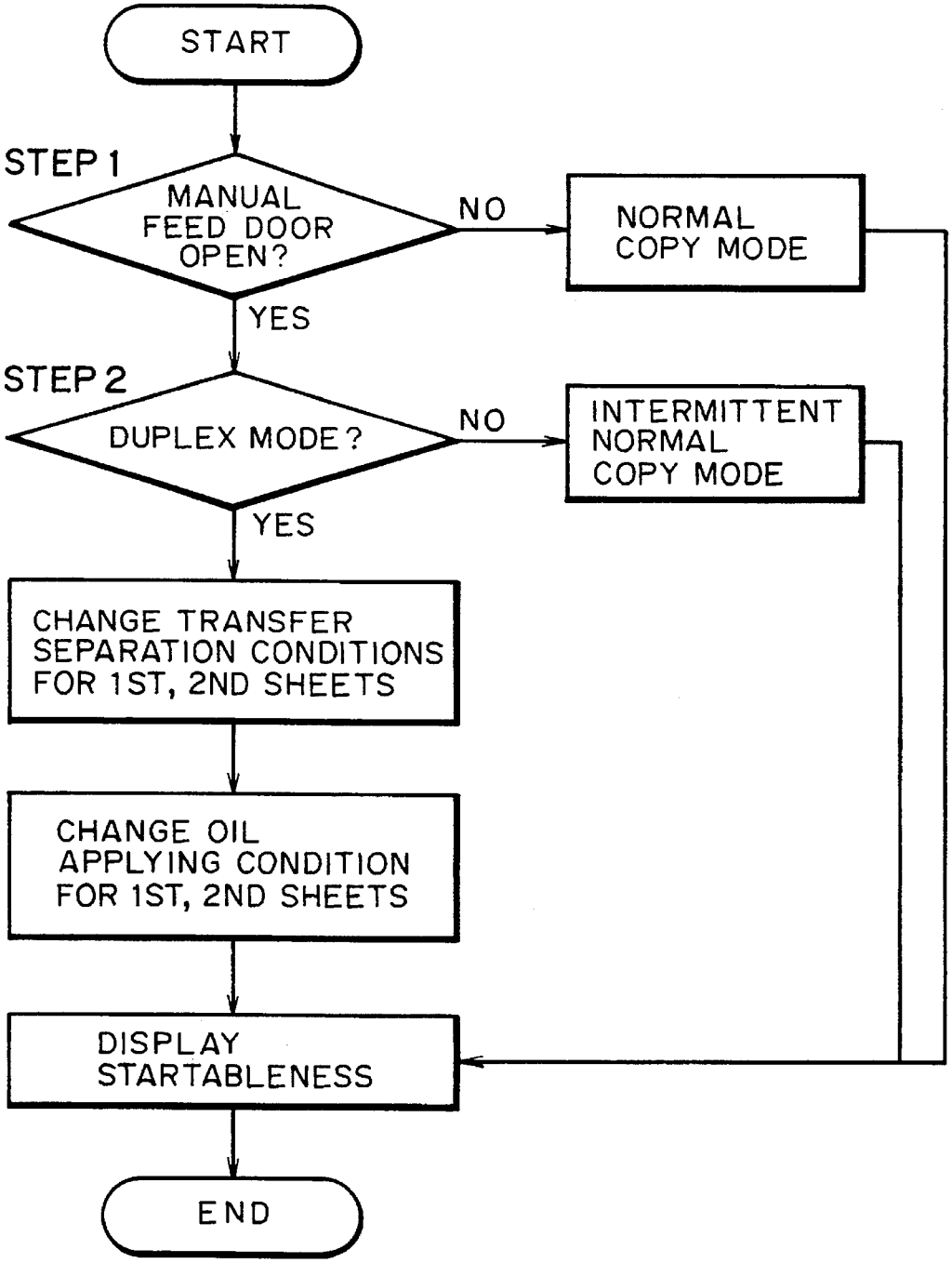
FIG. 6 is a flowchart of the algorithm for selecting the image forming mode according to the present invention.

FIG. 4 is a plan view of the control panel of the apparatus shown in FIG. 1, and FIG. 6 is a flowchart.

First, the double side image forming mode is set by pressing a double side copy button 201 on the control panel 200, which is one of the selecting means for selecting the condition of the image to be formed on the recording material. However, when a lamp 202 is not on, the double side image forming mode is not operable.

In other words, in order to carry out the double side image forming operation in this embodiment, the lamp 202 must be on. The lamp 202 is turned on when a door motion sensor 102 detects that a door 101 of a manual sheet feeding station 103 has been opened to feed manually the recording material (that is, a sheet of paper) (Step 1). The door 101 also serves as a sheet feeding tray. When the above mentioned sequence takes place, the double side image forming mode becomes operable for the first time (Step 2). When the door 101 is open, it is not possible to feed the recording material through the feed cassette 2 or 3.

When the double side copy button 201 is pressed after the lamp 202 is turned on, the double side image forming mode is set. Then, as soon as a sheet of paper is fed through the manual sheet feeding station 103, the sheet sensor 104 detects that the sheet has been fed, which triggers the rotation of the sheet feeding roller 105, and the sheet of paper is fed further into the main assembly 1 of the apparatus.

The sheet of paper conveyed from the manual sheet feeding station 103 is further conveyed toward the transfer drum 15 through the conveying guides 7 and 8 by a number of conveying rollers 6 when the sheet reaches the transfer drum 15, it is carried on the circumferential surface of the transfer drum At this time, the leading end of the sheet, with reference to the direction in which the sheet is being conveyed, is gripped by the gripper 10, and other portion of the sheet is attracted onto the transfer sheet (unshown) spread on the transfer drum 15, by the attraction roller 9. As the transfer drum rotates, the sheet carried on the transfer drum 15 is delivered to the transfer station (where the transfer drum 15 is in contact with the photosensitive drum 19), where a toner image (visible image) which has been formed on the photosensitive drum 19 in the aforementioned manner) is transferred by the transfer charger 13. After the completions of two or more transfer operations, which was described before, the recording material is subjected to the charges by the separation chargers 14 and 11, and the charge clearing charger 20, and is separated by the separating claw 12. Then, the toner image on the recording material is fixed by the fixing apparatus 18, and the recording material is discharged into the discharge tray 17, with the image facing upward.

Next, the image forming process for the other surface, that is, the second surface of the recording material, will be described.

The sheet of paper which is discharged into the discharge tray 17 after the image is formed on its first surface in the above described manner is inserted in the same state as it is discharged, that is, in the state in which the surface on which the image is on is facing upward, through the manual feeding station 103. Then, the image is formed on the second surface in the same manner as the first surface, and the recording material is discharged into the discharge tray 17, with the second surface facing upward this time.

However, according to this embodiment, there are differences in the first and second image forming processes. In other words, the operations of the transfer charger and discharge charger, and the amount of the oil coated on the fixing roller are different.

Figure 5:
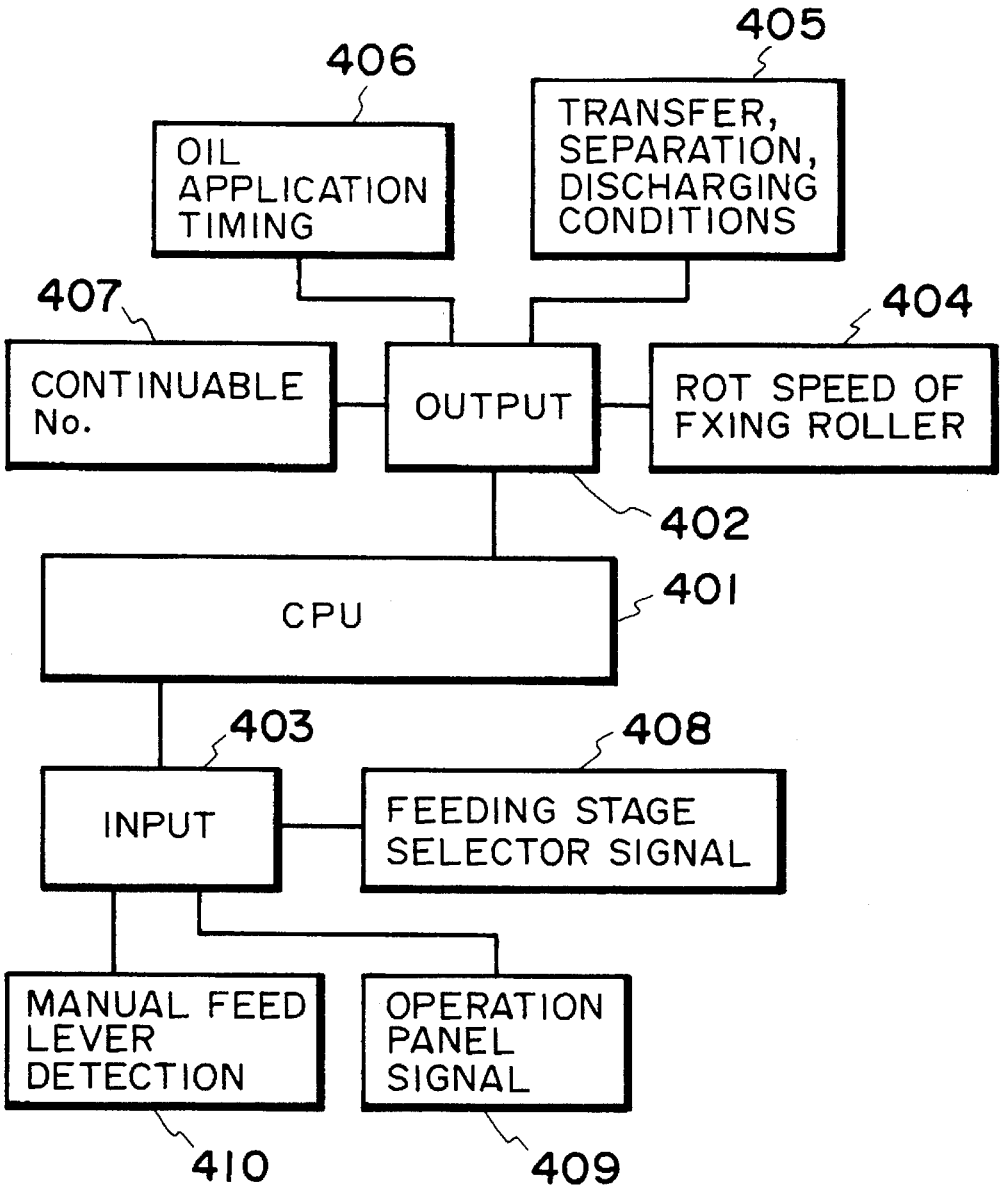
FIG. 5 is a block diagram of a controlling means for selecting the image forming mode according to the present invention.

Referring to FIGS. 1, 3, and 5, more specific description will be given. First, when the image is formed on both surfaces of the recording material, it is necessary to leave the least amount of oil on the toner image surface during the image formation on the first surface; therefore, it is necessary to reduce the amount of oil coated during the fixing operation, compared to the normally left amount. In order to accomplish this, an output signal 402 is issued from a CPU 401 in response to the input signals 403 consisting of feeding stage selector signal 408, operation panel signal 409 and manual feed lever detector and 410 of the controlling apparatus shown in FIG. 5, so that the oil coating apparatus O in the fixing apparatus is not going to be driven. Output signals control the continuable no. 407, the oil application timing 406, the transfer, separation and discharging conditions 405 and the rotational speed of the fixing roller 404.

Needless to say, since the oil is not coated during the image forming operation for the first surface, the oil to be left on the first toner image surface has to come from the residual oil on the fixing roller 29. As a result, the amount of oil at this time is no more than one tenth, or one hundredth or so, compared to the normally coated amount. Thus, the separating oil is prevented from migrating from the transfer drum to the photosensitive drum during the image formation on the second surface, whereby it becomes possible to prevent the feed roller from slipping. Also, since the feeding operation is in manual mode, the intermittent image forming condition is automatically selected, and it is possible to coat the fixing roller 29, as needed, with the separating oil after the image on the first surface is fixed, which in turn makes it possible to set the operational condition for the double side image formation, without liability of reducing the service life of the fixing roller even during a continuous image forming operation.

When the image is formed on the first surface, the chargers 11, 14, and 20 are all operated in the same manner as they are in the normal image forming mode. On the other hand, when the image is formed on the second surface, the chargers 14 and 20 are not operated, and only the separating charger 11 is operated. AS for the amount of oil coated in the fixing station, it is the same as is in the normal mode.

The reason why the image forming condition is changed between the first and second surfaces, as was described above, is as follows.

After the completion of the image formation on the first surface, the image on the transfer material is thermally fixed through the first fixing operation, whereby the oil, that is, the parting agent, adheres to the toner image and the transfer material. Then, when this transfer material is fed a second time for the image formation on the second surface, the surface on which the toner image is fixed during the first fixing operation (in other words, the surface on which the oil is adhering) comes to face the transfer drum 15. As a result, the oil adhering to the toner image and the transfer material migrates onto the transfer sheet as the transfer material is wrapped around the transfer drum 15. Then, after the transfer material is separated from the transfer drum 15, the oil, which is now on the transfer drum, migrates onto the photosensitive drum 19.

When the oil migrates or is transfered onto the photosensitive drum 19 in this manner, it may become impossible for the cleaning apparatus 21 to remove the toner on the photosensitive drum 19, or the toner may adhere to the oil adhering to the photosensitive drum 19, on the areas where the latent image is not, which ultimately leads to production of a dirty print soiled by the toner adhering to unnecessary areas of the recording material during subsequent image forming operations.

Further, since the oil, that is, the parting agent, is on the surface with the toner image, this oil comes in contact with the sheet feeding rollers 4 and 5 when the recording material is fed the second time, whereby the rollers 4 and 5 are liable to slip, failing to convey the recording material.

Also, there is another problem. In order to form a color image, a large amount of toner is needed, and this large amount of toner increases the rigidity of the transfer material. When this transfer material with the increased rigidity is cleared of the charge to be separated from the transfer drum 15, as was described previously, it may snap itself off the transfer drum 15, being liable to cause its surface with the image to come in contact with the components around the transfer drum.

Further, the image formation on the second surface may be carried out with the double side image formation button 201 being off. In other words, the image forming operation may be carried out by turning on the manual feeding lever through the control panel button 203. In this case, the transfer material is cleared of less charge, as was described previously, when the transfer material is separated from the transfer drum 15. Therefore, even if the rigidity of the recording material is extremely increased because of the high density of the image on the first surface, the attracting force strong enough to overcome this rigidity can be maintained between the transfer drum 15 and the recording material, whereby it is possible to convey the transfer material without allowing the recording material to snap off. Also, since the separating oil is coated in synchronization with the entrance timing of the transfer material, a small amount of oil remains in the contact area between the rollers, which effectively serves to assure the separability of the leading end of the recording material from the upper and lower rollers even if the back side of the recording material has an image. Thus, the preferable image is formed on both sides of the recording material.

Further, in the image forming apparatus illustrated in FIG. 1, the transfer material fed through the manual feeding station 103 during the manual feeding operation is conveyed by the conveying means, toward the under side of the transfer drum 15, when the top side of the transfer material faces the circumferential surface of the transfer drum, and after the fixing operation, the recording material discharged into the discharge tray 17, with the surface with the fixed image facing upward.

With such a structure in place, it is possible to form the image on the second surface by simply inserting the transfer material discharged after the image formation on the first surface, through the manual sheet feeding station, without turning it over.

Next, a case in which an image 18 formed on a transparent resin film such as a film used for an will be described.

Referring to FIG. 1, a reference numeral 61 designates a photosensor for discriminating whether or not the recording material is of resin film, and/or whether or not the surface facing upward is the front surface of the resin film.

When an image is formed on the resin film, the image cannot be fixed as well as on plain paper. Therefore, the peripheral velocity of the fixing roller is reduced to 25 mm/sec, from 90 mm/sec, which is for paper.

Figure 7:
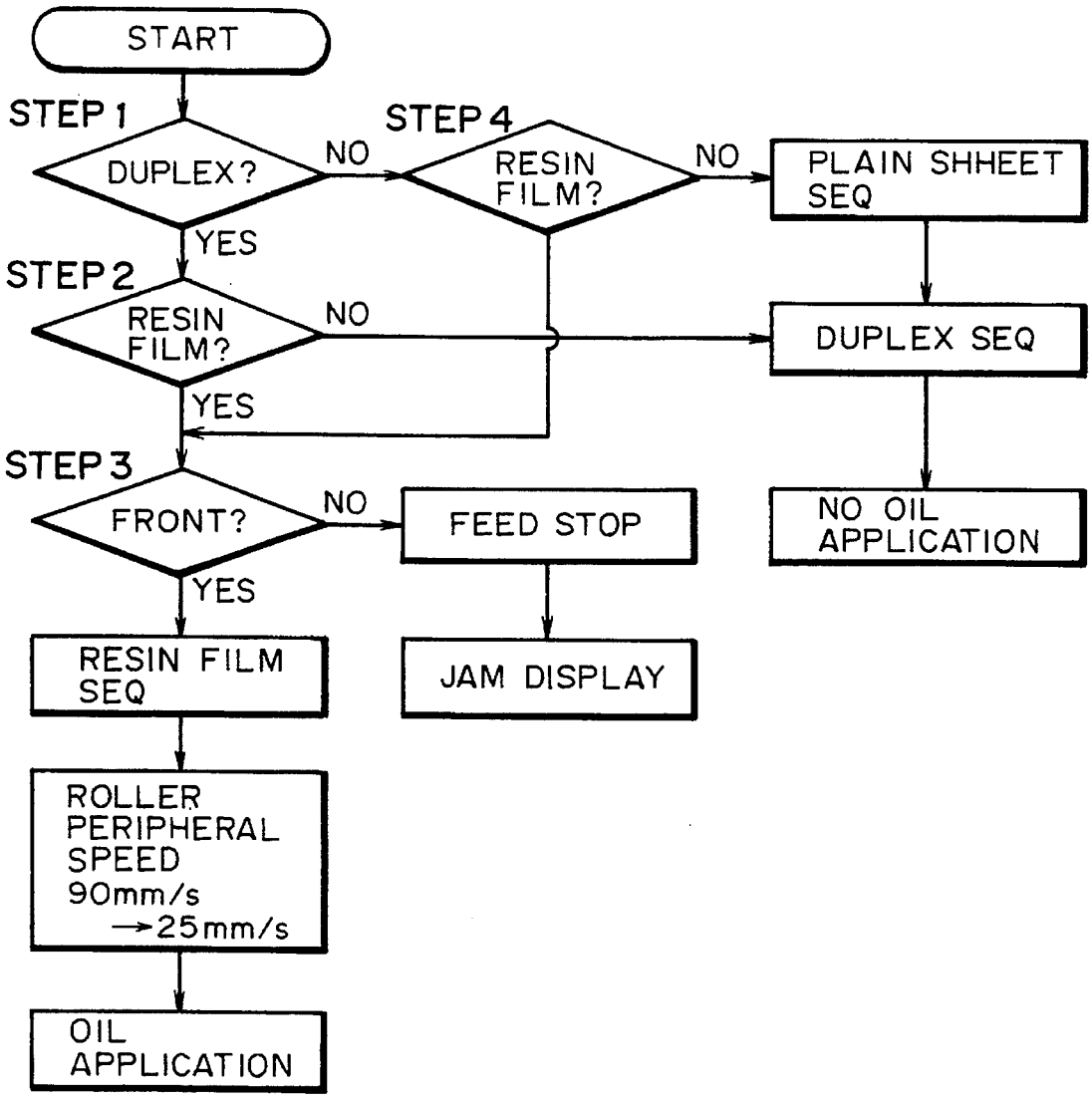
FIG. 7 is a flowchart for the embodiment of the present invention.

FIG. 7 is a flowchart of the double side image forming operation sequence in conjunction with a sequence for forming an image on the resin film.

First, after the double side mode is set in Step 1, it is discriminated whether or not the recording material is of the resin film, an Step 2. When it is detected that the recording material is of the resin film, it is further discriminated whether or not the upward facing surface is the front surface. As for the details of this method for discriminating the front surface from the back, they are disclosed in the U.S. Pat. No. 5,126,762.

When the upward facing surface is the front surface, the resin film sequence is initiated, wherein the double side image forming operation is not carried out.

When the upward facing surface is the back side of the recording material, the conveying operation is stopped, whereby the resin film is prevented from reaching the transfer drum, and at the same time, a jam is indicated on the display.

When it is detected in Step 2 that the fed recording material is not of the resin film, the aforementioned double side image formation sequence is carried out.

Further, when the double side mode is not set in Step 1, and also, it is detected that the recording material is not Of the resin film, a sequence for a single side plain paper image formation mode is carried out.

With such a structure in place, it is possible to prevent the double side mode sequence from being mistakenly carried out on the resin film, and also, the toner off-set caused by lack of the separating oil, as well as the separating oil adhesion to the photosensitive member, are prevented, which in turn prevents a production of a print.

Embodiment 2

In the preferred embodiment, the double side image forming mode was described. However, in this embodiment, it is also possible to set different modes other than the double side mode, by manipulating the control panel button 203 to select a different sheet feeding tray. In other words, by selecting only the manual feeding lever, the amount of charge given during the operation for separating the transfer material can be reduced, whereby even the paper, which might snap off during the separating operation because of having too much rigidity to meet the separating condition for a conventional thin sheet of paper, can be separated from the transfer drum in such a manner as to follow the conveyance passage. Therefore, paper having a larger basis weight than the conventional paper can be used.

Embodiment 3

In this embodiment, in addition to the double side mode button 201, a glossiness section button 206 is provided on the control panel 200, as shown in FIG. 4, whereby another mode can be added, in which the fixing speed can be changed. In this case, the processing conditions are separately set up for the manual lever feeding and cassette feeding operations, whereby it becomes possible to select different modes to increase the glossiness, corresponding to the types of various recording material, as shown in Table 1.

TABLE 1

| | | Manual Feed Lever | |
|---|---|---|---|
| | | ON | OFF |
| Glossiness selector | ON | Thick sheet glossy mode<br>Lower fixing speed<br>Oil amount<br>Deactuate transfer separation discharge | Plain paper glossy mode<br>No oil application upon fixing |
| | OFF | Plain paper mode<br>Deactuate transfer separation discharge | Plain paper<br>Continuous mode |

In this embodiment, images having various degrees of glossiness can be produced by selecting one of the modes shown in Table 1.

While the invention has been described with reference to the structures disclosed therein, it is not confined to the details set forth and this application is intended to cover such modifications or changes as may come within the purposes of the improvements or the scope of the following claims.

What is claimed is:

1. An image forming apparatus comprising:

manual sheet feeding means for permitting a recording material to be manually fed;

image forming means for forming an image on the fed recording material;

double side mode selecting means for selecting a double side mode in which images are formed on both surfaces of the recording material;

wherein said image forming means is conditioned for forming images on both surfaces when said manual feeding means is in manual feeding state, the double side mode is selected by said double side mode selecting means and an image formation on a second side of the recording material is effected on the recording material fed by said manual sheet feeding means.

2. An image forming apparatus according to claim 1, wherein said manual sheet feeding means comprises an openable manual feeding station and detecting means for discriminating whether said manual feeding station is open or closed.

3. An image forming apparatus according to claim 1, wherein said apparatus comprises a control panel operable by an operator, and said double side mode selecting means comprises a double side mode selector provided on the control panel.

4. An image forming apparatus according to claim 1, further comprising a rotatable fixing member for fixing the image on the recording material, and a coating member for coating parting liquid on said rotatable fixing member.

5. An image forming apparatus according to claim 4, wherein, when the image is formed on a first surface of the recording material in operation of the double side mode, said image forming means reduces the amount of the parting liquid applied on said rotatable fixing member, compared to during a single side image forming mode.

6. An image forming apparatus according to claim 5, wherein said image forming means comprises an image bearing member for bearing an unfixed image, and a recording material carrying member which carries the recording material while rotating in contact with said image bearing member.

7. An image forming apparatus according to claim 6, wherein said image forming means produces a full-color image through a process in which unfixed images of different color are sequentially transferred from said image bearing member onto the recording material carried on said recording material carrying member, and the unfixed images of different color are mixedly fixed on the recording material to produce the full-color image.

* * * * *

UNITED STATES PATENT AND TRADEMARK OFFICE

CERTIFICATE OF CORRECTION

PATENT NO. : 5,463,457

DATED : October 31, 1995

INVENTOR(S) : TATSUO TAKEUCHI, ET AL.

It is certified that error appears in the above-indentified patent and that said Letters Patent is hereby corrected as shown below:

Title page,

Item [57] ABSTRACT:

line 12, "selecter." should read --selector.--.

Figure 5, (in the drawing)

"FXING" should read --FIXING--.

Column 2, line 7, "An" should read --in--;

line 15, "means" should read --means,--;

line 17, "material." should read --material,--;

line 29, "mode" should read --mode,--; and line 32, detect's" should read --detects--.

Column 4, line 1, "ratus" should read --ratuses--.

Column 6, line 48, "In" should read --in--.

Column 7, line 66, "rollers 6 when" should read --rollers 6. When--.

Column 8, line 1, "drum" should read --drum 15.--; and line 47, "and" should be deleted.

UNITED STATES PATENT AND TRADEMARK OFFICE

CERTIFICATE OF CORRECTION

PATENT NO. : 5,463,457

DATED : October 31, 1995

INVENTOR(S) : TATSUO TAKEUCHI, ET AL.

It is certified that error appears in the above-indentified patent and that said Letters Patent is hereby corrected as shown below:

Column 10, line 21, "18" should read --is--;
line 22, "an" should read --an OHP--;
line 36, "an" should read --in--; and
line 54, "Of" should read --of--.

Signed and Sealed this

Ninth Day of April, 1996

Bruce Lehman

*Attest:*

BRUCE LEHMAN

*Attesting Officer*

*Commissioner of Patents and Trademarks*